US005861596A

United States Patent [19]

Grass et al.

[11] Patent Number: 5,861,596

[45] Date of Patent: Jan. 19, 1999

[54] DUAL BAFFLE APPARATUS FOR ELECTRICAL SWITCHING DEVICE

[75] Inventors: William E. Grass, Village of Sussex, Wis.; Amelia M. Stay, Rochester, Pa.; Earl T. Piber, Oconomowoc, Wis.; Roger E. Walker, Franklin Township, Pa.

[73] Assignee: Eaton Corporation, Cleveland, Ohio

[21] Appl. No.: 834,685

[22] Filed: Apr. 1, 1997

[51] Int. Cl.[6] ..... H01H 33/18; H01H 33/75; H01H 33/02

[52] U.S. Cl. ..... 218/34; 218/105; 218/149

[58] Field of Search ..... 218/34, 38, 39, 218/105, 149, 151; 335/201

[56] References Cited

U.S. PATENT DOCUMENTS

| | | | |
|---|---|---|---|
| 2,306,204 | 12/1942 | Boehne | 218/149 |
| 2,393,164 | 2/1946 | Hobson | 218/149 |
| 2,477,189 | 7/1949 | Lerstrup | 218/149 |
| 3,031,552 | 4/1962 | Stewart | 218/151 |
| 3,641,294 | 2/1972 | Amitage et al. | 200/144 R |
| 3,815,059 | 6/1974 | Spoelman | 335/16 |
| 4,618,751 | 10/1986 | Wehr et al. | 200/144 R |
| 4,645,890 | 2/1987 | Paton et al. | 200/153 G |
| 4,698,606 | 10/1987 | Mrenna et al. | 335/45 |
| 4,827,369 | 5/1989 | Salette et al. | 361/96 |
| 4,887,057 | 12/1989 | Gula et al. | 335/190 |
| 4,950,853 | 8/1990 | Crookston | 200/144 R |
| 4,963,846 | 10/1990 | Grunert et al. | 335/42 |
| 4,973,927 | 11/1990 | Carothers et al. | 335/10 |
| 5,200,724 | 4/1993 | Gula et al. | 335/166 |
| 5,223,681 | 6/1993 | Buehler | 200/144 R |
| 5,278,373 | 1/1994 | Faber et al. | 200/401 |
| 5,341,191 | 8/1994 | Crookston et al. | 335/16 |
| 5,466,903 | 11/1995 | Faber et al. | 200/400 |

*Primary Examiner*—Wynn Wood Coggins
*Assistant Examiner*—Michael J. Hayes
*Attorney, Agent, or Firm*—Martin J. Moran

[57] ABSTRACT

A baffle for use in a circuit breaker includes a first baffle mechanism and a second baffle mechanism. Each of the first and second baffle mechanisms includes a base, a plurality of elongated members supported by the base, and cross-pins or other elongated members for supporting the base of one of the baffle mechanisms substantially parallel to the base of the other baffle mechanism. The elongated members of the first and second baffle mechanisms are interleaved to form a labyrinth.

22 Claims, 7 Drawing Sheets

FIG. 3
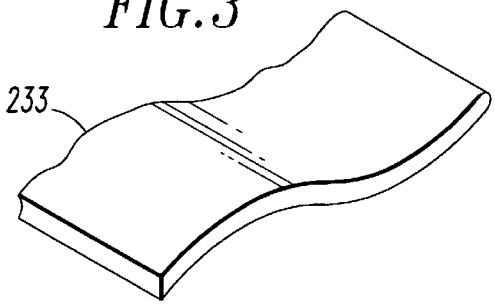
FIG. 4
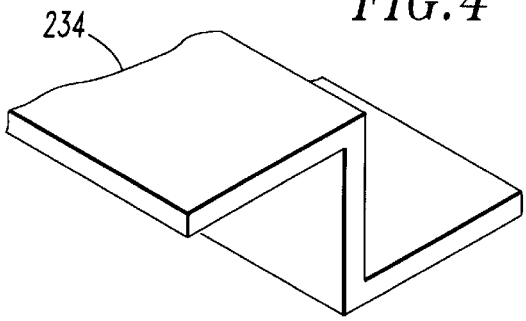
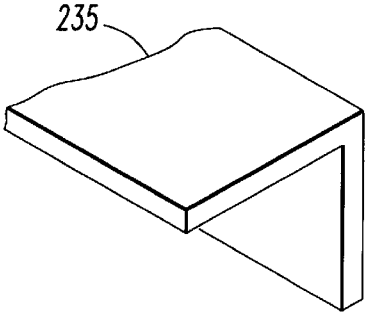
FIG. 5
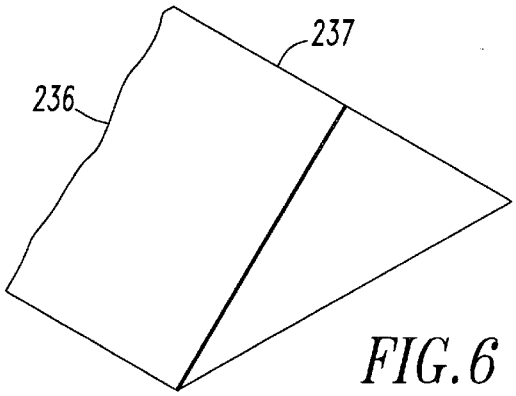
FIG. 6
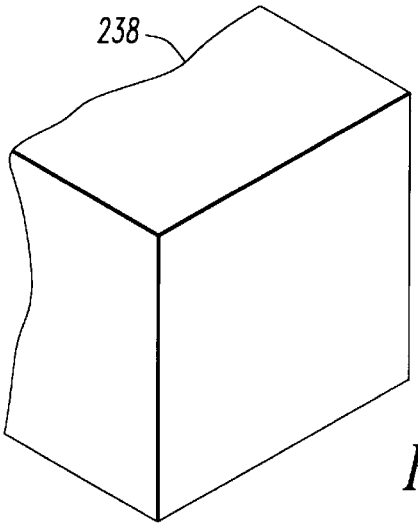
FIG. 7

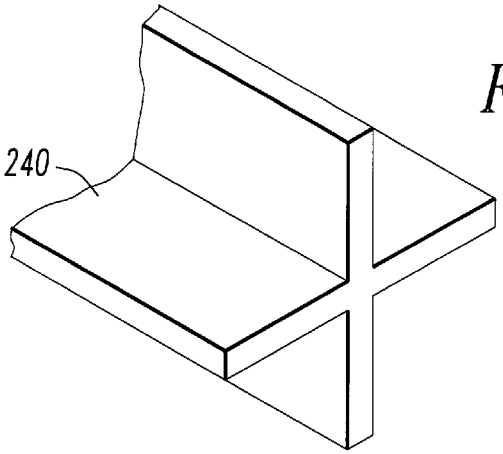
FIG. 8
FIG. 9
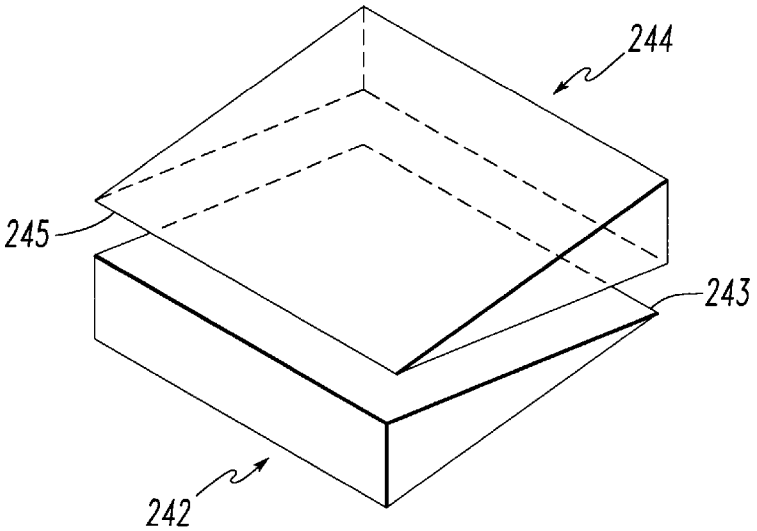
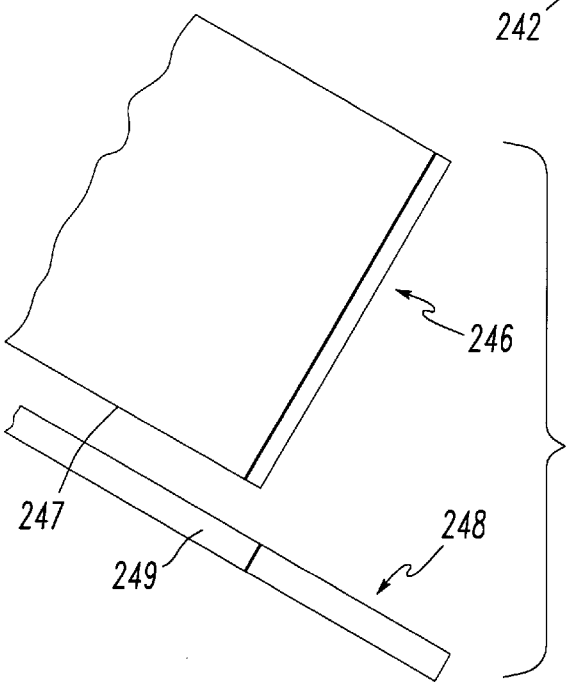
FIG. 10

FIG. 11
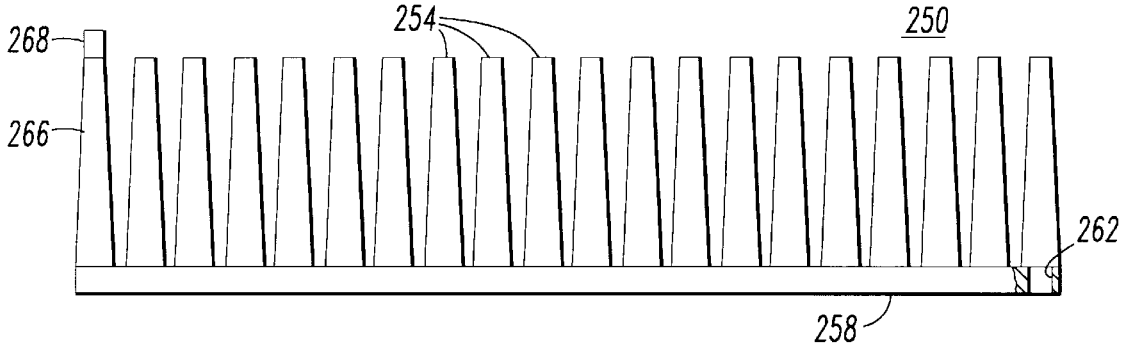
FIG. 12
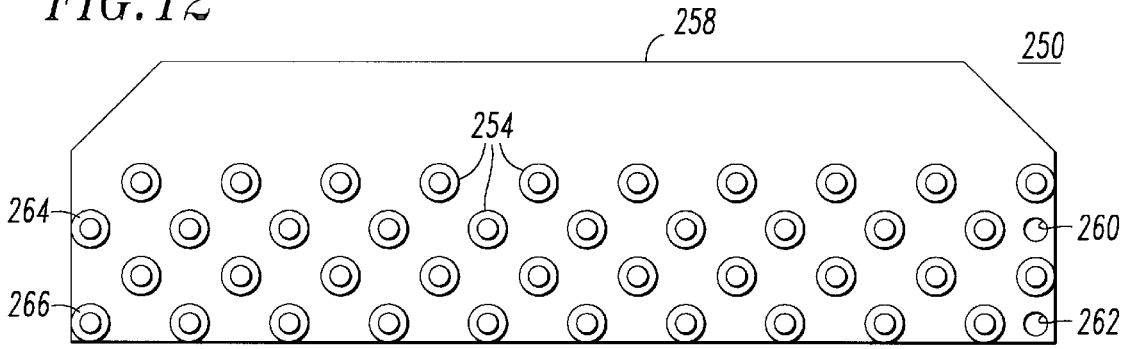
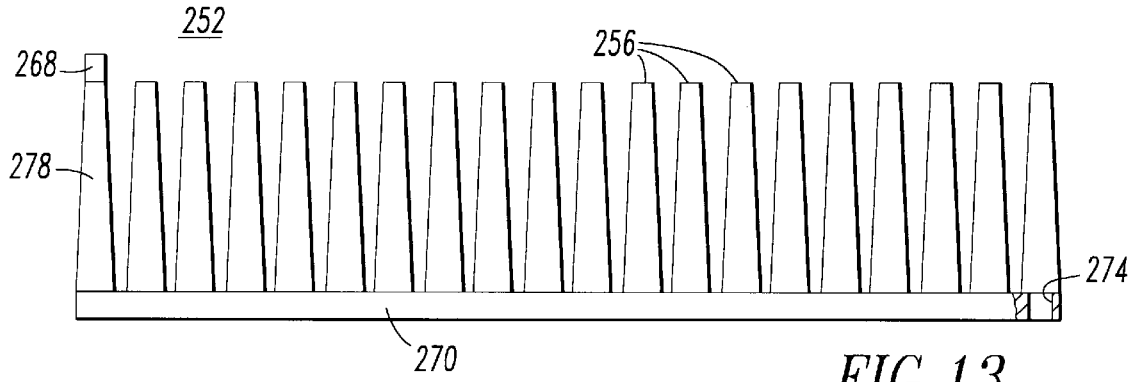
FIG. 13
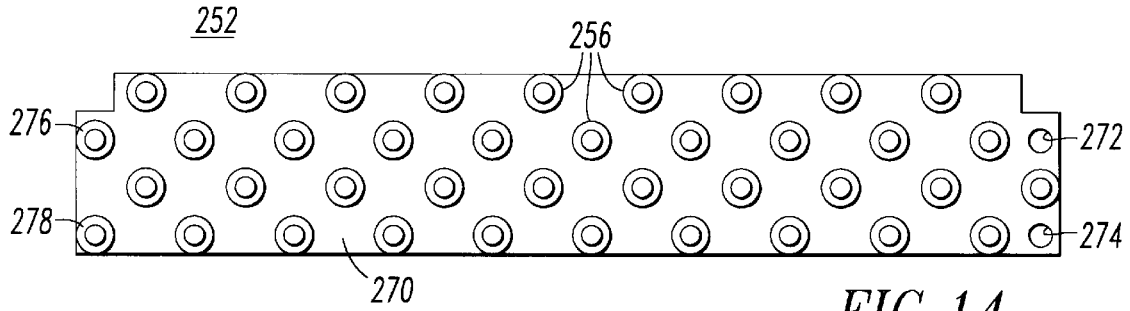
FIG. 14

DUAL BAFFLE APPARATUS FOR ELECTRICAL SWITCHING DEVICE

BACKGROUND OF THE INVENTION

1. Field of the Invention

This invention relates to an electrical switching device and, more particularly, to a circuit interrupter, such as a circuit breaker, including a baffle.

2. Background Information

Electrical switching devices include, for example, circuit switching devices and circuit interrupters, such as circuit breakers, contactors, motor starters, motor controllers and other load controllers. Circuit breakers are generally old and well known in the art. Examples of circuit breakers are disclosed in U.S. Pat. Nos. 4,887,057; 5,200,724; and 5,341,191. Such circuit breakers are generally used to protect electrical circuitry from damage due to an overcurrent condition, such as an overload fault or a relatively high level short circuit condition.

Molded case circuit breakers, for example, include a pair of separable contacts per phase; an operating mechanism designed to rapidly open and close the separable contacts; a handle disposed on the outside of the case for operating the operating mechanism manually; and a trip mechanism for tripping the operating mechanism automatically in response to an overcurrent condition.

When the circuit breaker is on, a movable contact assembly is in contact with a stationary or fixed contact assembly. The closed contact assemblies conduct a flow of current between a line terminal and a load terminal. When the circuit breaker trips or is switched off, the movable contact assembly is moved away from the fixed contact assembly, thus, interrupting the flow of current between the line and load terminals. Examples of molded case circuit breakers are disclosed in U.S. Patent Nos. 3,815,059; 4,618,751; 4,645,890; 4,698,606; 4,827,369; 4,950,853; 4,963,846; 4,973,927; 5,223,681; and 5,278,373.

Some types of circuit breakers include an electro-mechanical trip unit which interrupts current flow in two or more modes of operation. The electro-mechanical trip unit generally senses overload currents of up to about five to six times normal rated current as well as short circuit currents of greater than about ten times normal rated current. Other types of circuit breakers include an electronic trip unit for automatically interrupting the current flow.

During an overcurrent condition, the fixed and movable contact assemblies part, with the current flowing therethrough forming an arc therebetween. Some circuit breakers employ an electrical arc chute or arc stack to divide a single electrical arc formed between the separable contacts upon a fault condition into a series of smaller electrical arcs, increase the total arc voltage, and extinguish the electrical arc.

Many arc stacks for circuit breaker venting structures are designed to release arc gas products from the circuit breaker in a manner to aid in the interruption of the circuit and to vent the gases in a safe manner such as by cooling and deionizing them. The forced flow of gases through an obstacle pathway provides a restriction of gas flow and causes high chamber pressures within the circuit breaker casing.

It is known to use multiple, generally parallel, arc plates to provide a series of vertical chambers which cause changes in the direction of gaseous flow and result in turbulence and an attendant cooling of the moving gases. It is also known to provide a back-to-back louvered arc stack and baffle arrangement to facilitate a relatively free flow of gases while sufficiently cooling and deionizing the gases. However, there is room for improvement.

There is a need for a relatively low-cost, easy to manufacture baffle arrangement for an electrical switching device and, in particular, a circuit interrupter in which arcs occur.

There is also a need for such a baffle arrangement for an electrical switching device and, in particular, a circuit interrupter in which arcs occur, which is easily reconfigured in the manufacturing process to vary the flow of gases.

SUMMARY OF THE INVENTION

The present invention is directed to a dual baffle arrangement for an electrical switching device. The baffles employ a plurality of elongated members, supported by a base, which are interleaved to form a labyrinth. The labyrinth formed by the elongated members provides obstacle pathways for arc gas products in the electrical switching device and, hence, a large surface area for cooling of the gases.

As one aspect of the invention, a baffle apparatus for use in an electrical switching device comprises first baffle means and second baffle means. Each of the first and second baffle means comprises a base, a plurality of elongated members supported by the base, and means for supporting the base of one of the first and second baffle means substantially parallel to the base of the other of the first and second baffle means. The elongated members of the first and second baffle means are interleaved to form a labyrinth.

Variations in the cross section of the elongated members may be employed to improve baffle strength or to improve turbulence of arc gas products in the electrical switching device.

As another aspect of the invention, an electrical switching apparatus comprises: a housing; separable contacts within the housing having a closed position and an open position; operating means for operating the separable contacts between the closed position and the open position thereof; at least one first baffle means about adjacent the separable contacts; and at least one second baffle means cooperating with the at least one first baffle means. Each of the first and second baffle means comprises a base, a plurality of elongated members supported by the base, and means for supporting the base of one of the first and second baffle means substantially parallel to the base of the other of the first and second baffle means. The elongated members of the first and second baffle means are interleaved to form at least one labyrinth.

As a further aspect of the invention, an electrical switching apparatus comprises: a housing having an arc chamber therein; separable contacts in the arc chamber having a closed position and an open position; operating means for operating the separable contacts between the closed position and the open position thereof; arc chute means in the arc chamber for dividing an arc between the separable contacts; at least one first baffle in the arc chamber about adjacent the arc chute means; and at least one second baffle in the arc chamber cooperating with the at least one first baffle. Each of the first and second baffles comprises a base, a plurality of elongated members supported by the base, and means for supporting the base of one of the first and second baffles substantially parallel to the base of the other of the first and second baffles. The elongated members of the first and second baffles are interleaved to form a labyrinth.

BRIEF DESCRIPTION OF THE DRAWINGS

FIGS. 3–10 are isometric views, in cross section, of elongated members in accordance with alternative embodiments of the invention;

FIG. 11 is a side view of one baffle in accordance with an embodiment of the invention;

FIG. 12 is a plan view of the baffle of FIG. 11;

FIG. 13 is a side view of a baffle for mating with the baffle of FIG. 11;

FIG. 14 is a plan view of the baffle of FIG. 13;

DESCRIPTION OF THE PREFERRED EMBODIMENT

As employed herein, the term "labyrinth" shall expressly include, but not be limited to a structure forming a plurality of interconnecting passages, and/or an arrangement, such as an array, of partitions and/or members for affecting the flow of a gas.

As employed herein, the term "recess" shall expressly include, but not be limited to a depression, indentation, hollow, hole or opening.

Figure 1:
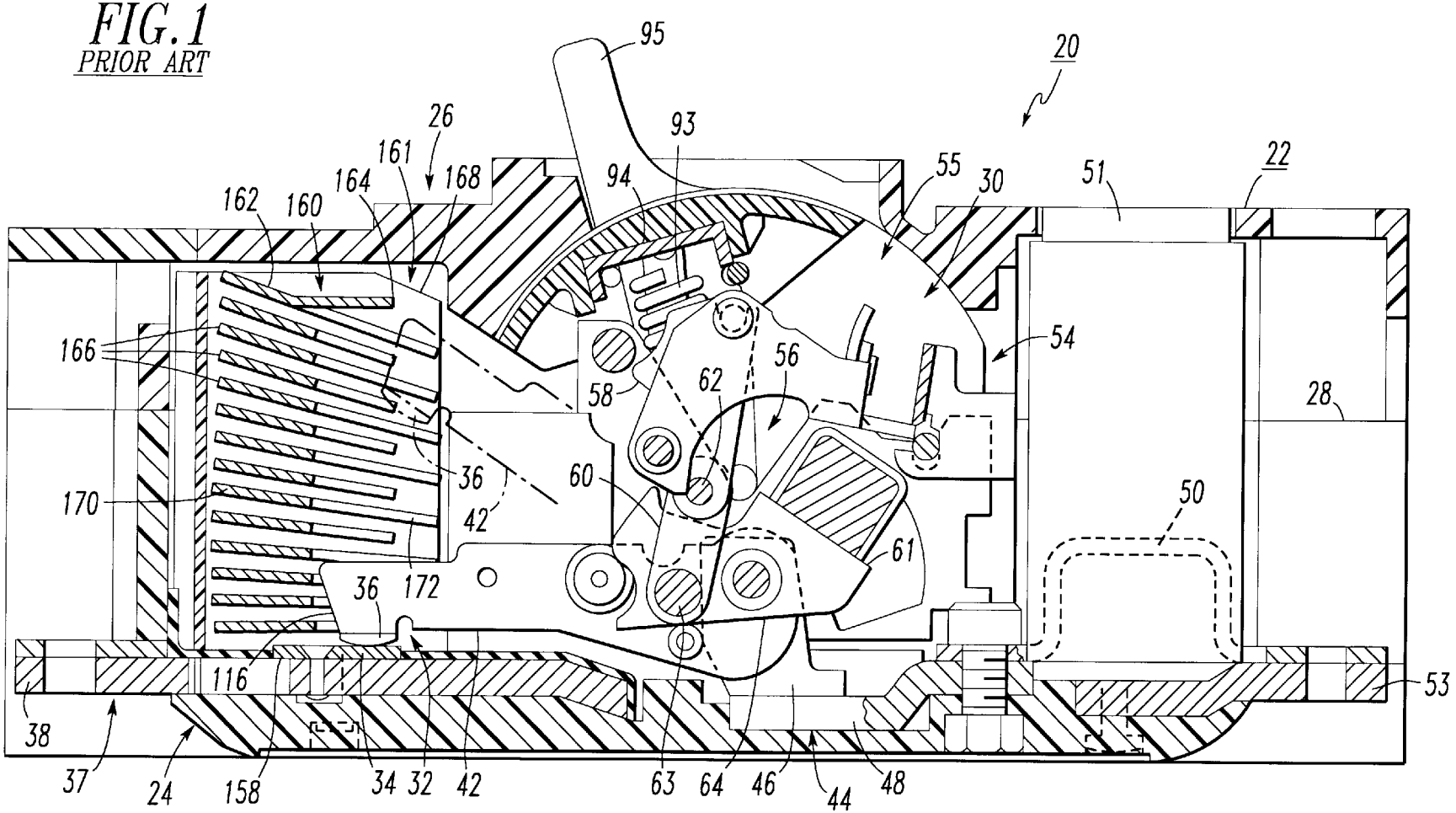
FIG. 1 PRIOR ART
FIG. 1 is a vertical sectional view of a circuit breaker.

A typical example of a circuit breaker is disclosed in U.S. Pat. No. 4,973,927 which is herein incorporated by reference. The reference numerals up to and including 160 employed herein are consistent with those used in U.S. Pat. 4,973,927. Referring to FIG. 1, a molded case circuit breaker 20 includes an electrically insulated housing 22 having a molded base 24 and a molded coextensive cover 26, assembled at a parting line 28. The internal cavity of the molded base 24 is formed as a frame 30 for carrying the various components of the circuit breaker 20, although the principles of the present invention are applicable to various types of electrical switching devices.

At least one pair of separable main contacts 32 are carried by the frame 30 in an arc chamber 161. More specifically, the pair of main contacts 32 include a rigidly mounted main contact 34 and a movably mounted main contact 36. The rigidly mounted main contact 34 is mounted to a line side conductor 37 having a line side terminal portion 38 at one end.

For each phase (only one phase is shown), the movable contact 36 is carried by a contact arm 42. The contact arm 42 is pivotally connected to a load conductor assembly 44. The load conductor assembly 44 includes a pivot bracket 46, rigidly connected to a load conductor base 48. The load conductor base 48 is rigidly mounted to the frame 30 and electrically connected to a U-shaped load conductor 50 (shown in hidden line drawing). The U-shaped load conductor 50 forms a portion of an electronic trip unit 51. One end of the U-shaped conductor 50 is secured to the frame 30 and the load conductor base 48. The other end of the U-shaped conductor 50 is electrically connected to a load side terminal 53 to allow connection to an external electrical circuit (not shown). The separable contacts 34,36 have a closed position and an open position (as shown in phantom line drawing with contact 36 and contact arm 42).

The electronic trip unit 51 contains one or more internal current sensors for detecting current flowing through the main contacts 32. The electronic trip unit 51 also includes a latch mechanism 54 which is interlocked with an operating mechanism 55 of the circuit breaker 20. Upon detection of an overcurrent condition, the electronic trip unit 51 operates the latch mechanism 54 to unlatch the circuit breaker operating mechanism 55 to allow the main contacts 32 to be separated.

The operating mechanism 55 is provided for opening and closing the main contacts 32. The operating mechanism 55 includes a toggle assembly 56 having a pair of upper toggle links 58 and a pair of lower toggle links 60 (only one link of each pair 58,60 is shown). Each upper toggle link 58 is pivotally connected at one end to the corresponding lower toggle link 60 about a pivot axis 62. The other end of each of the lower toggle links 60 is pivotally connected about a pivot axis 63 to a U-shaped bracket 61, having depending operating arms 64 (only one arm 64 is shown).

For each phase, an arc runner 158 is disposed adjacent the stationary contact 34 in the arc chamber 161, between the lower portion of an arc chute 160 and the stationary contact 34, to induce an arc to travel into the arc chute 160. The arc chute 160, for each of the phases, divides a single electrical arc, formed as a result of the separation of the main contacts 32, into a series of electrical arcs, thereby increasing the total arc voltage and limiting the magnitude of the fault current.

The circuit breaker 20 may also be manually turned off by rotating an insulated operating handle 95, mechanically coupled to the handle arm 94, in a clockwise direction (with respect to FIG. 1) to the open position thereof (not shown). This causes the toggle assembly 56 to collapse, which allows the contact arms 42 (only one is shown) to rotate upwardly to their open position (as shown in phantom line drawing) under the influence of the operating springs 93.

The arc chute 160 includes two insulating wrappers or supports 168 (only one is shown) and a plurality of the thin, generally U-shaped plates 162,166 (the sectional view of FIG. 1 shows the base 170 and one arm 172 of the U-shape) of electrically conductive magnetic material, such as, for example, nickel plated steel. The magnetic plates 162,166 are supported in a stacked, spaced, face-to-face relationship with the slots thereof aligned in order that the end 116 of the contact arm 42 for each phase moves within the slots in moving to the open position thereof (shown in phantom line drawing).

The Upper magnetic plate 162, which functions as an arc runner plate adjacent the top portion of the arc chute 160, is provided with an extending runner 164 which attracts the arc upon blow-open operation of the separable contacts 32. During the opening of the contact arm 42, the arc is magnetically drawn between the separable contacts 32, and the arc is magnetically drawn into the bight portions, defined by the U-shaped plates 162,166, where it is broken up into a plurality of serially related arcs to be extinguished in a well-known manner. The arc chute 160 provides an arc control zone which clips and sustains the voltage at a level which controls case pressure while forcing the current to zero. Once the arc path has transferred to the runner 164, it travels successively down the other plates 166 to the arc runner 158 and the stationary contact 34. By lengthening the arc, the voltage is increased.

Figure 2:
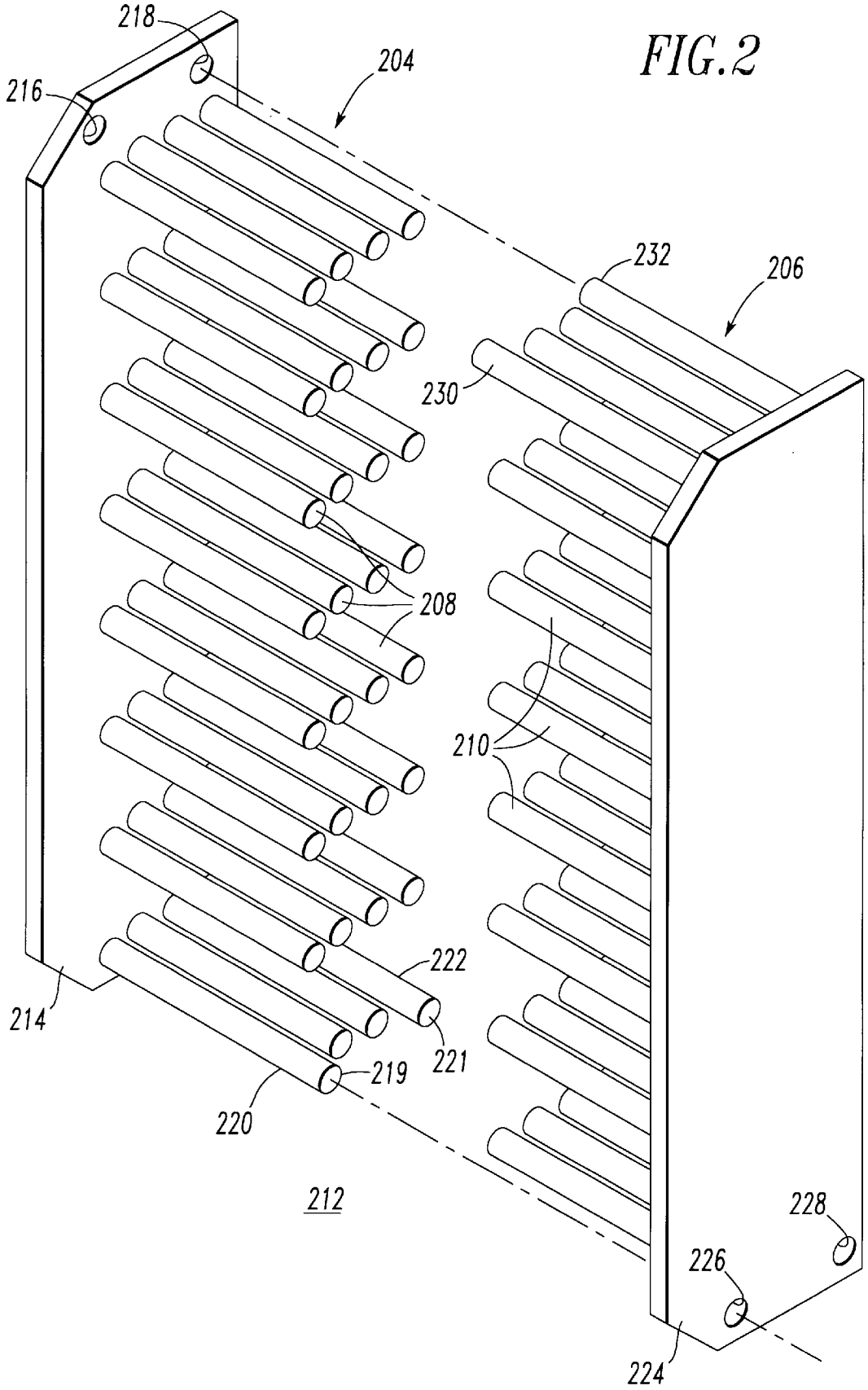
FIG. 2 is an exploded isometric view of a pair of cooperating unitary baffles each of which has a plurality of elongated members in accordance with the invention.

A circuit breaker arc chute may release arc gas products within the circuit breaker. In this case, it is preferred to aid in the interruption of the circuit and to cool and deionize the gases, such as by forcing the flow of the gases through an obstacle pathway or baffle. FIG. 2 illustrates a pair of circuit breaker baffles 204,206 having a plurality of elongated members 208,210, respectively. The unitary baffles 204,206, when interconnected, form a baffle assembly 212 for use in an electrical switching device (not shown). The baffle 204 includes a base 214 and the plural elongated members 208 supported thereby. The base 214 has a pair of holes 216,218 therein at about the upper end thereof (with respect to FIG. 2). At about the lower end of the base 214 are a pair of elongated cross-pins 220,222 for interconnection with the base 224 of the other baffle 206.

The second base 224 has a pair of holes 226,228 therein at about the lower end thereof. The cross-pins 220,222, which preferably are the same or similar in cross section as the elongated members 208, have first ends supported by the base 214 and second free ends 219,221 which are inserted in the holes 226,228, respectively, of the base 224 of the second baffle 206. At about the upper end of the base 224 are a second pair of elongated cross-pins 230,232 for interconnection with the base 214 of the first baffle 204. The ends of the cross-pins 220,222,230,232 are inserted into the respective holes 226,228,216,218 and interlock with the bases 214,224 in order to support the first base 214 substantially parallel to the second base 224. In this manner, the exemplary array (e.g., 4×8=32) of first elongated members 208 and cross-pins 220,222 is interleaved with a similar array (e.g., 4×8=32) of second elongated members 210 and cross-pins 230,232 to form a labyrinth of elongated members in a suitable array (e.g., 4×16=64), although it will be appreciated that a wide variety of labyrinths and arrays are possible. When the bases 214,224 are so assembled, the ends of the elongated members 208,210 are about adjacent the substantially parallel bases 224,214, respectively, although the invention is applicable to elongated members which engage or which do not engage the other base.

Also referring to FIGS. 3–10, isometric views, in cross section, of other embodiments of the elongated members are illustrated. In addition to a planar curve cross section, such as the generally circular cross section of the members 208,210 (FIG. 2), other embodiments of the cross sections include the S-shape of member 233 (FIG. 3), the Z-shape of member 234 (FIG. 4), the L-shape of member 235 (FIG. 5), the polygon shapes of the triangular member 236 (FIG. 6) and the square member 238 (FIG. 7), and the X-shape or plus-shape of the member 240 (FIG. 8). It will be appreciated the cross sections of the members 208,210,233,234, 235,236,238,240 are exemplary and a wide variety of other cross sections are possible (e.g., a generally elliptical cross section, a C-shape, a U-shape).

The members 208,210,233,234,235,236,238,240 of two opposing bases may be employed in a symmetrical manner, such as with the members 208,210 of FIG. 1, or such as with two cross sections having the same orientation (e.g., with the surface 237 of the triangular member 236 pointing in the same direction for both of the opposing bases).

In another embodiment, as shown in FIG. 9, the triangular members 242,244 have similar cross sections which are substantially the mirror image of each other. In this case, the surface 243 of the triangular member 242 points in the opposite direction with respect to the surface 245 of the mirror image triangular member 244.

In a further embodiment, shown in FIG. 10, the rectangular members 246,248 have similar cross sections which are substantially normal with respect to each other. In this case, the surface 247 of the rectangular member 246 is rotated about 90 degrees with respect to the surface 249 of the rectangular member 248. It will be appreciated that a baffle employing the members 242,244 and/or 246,248 in a suitable array of such members may advantageously affect the flow of arc gas products.

Referring to FIGS. 11–14, another pair of baffles 250,252 are illustrated. The baffles 250,252 have a plurality of elongated members 254,256, respectively. The baffles 250, 252, when interconnected (e.g., as discussed below in connection with FIG. 15), form a baffle assembly or sub-assembly for use in an electrical switching device (e.g., as discussed below in connection with FIGS. 15–16). The baffle 250 includes a base 258 and the plural elongated members 254 supported thereby. The base 258 has a pair of depressions 260,262 therein at about the right side thereof (with respect to FIG. 12). At about the left side of the base 258 are a pair of elongated members 264,266, which are preferably the same or similar in cross section as the elongated members 254. The elongated members 264,266 also have extensions 268 (as shown with member 266 in FIG. 11) at their free end for interconnection (not shown) with the base 270 of the other baffle 252. The exemplary elongated members 254,256 have a cross section of first diameter about adjacent the corresponding bases 258,270, respectively, and a cross section of second diameter, smaller than the first diameter, about adjacent the respective opposing bases 270,258.

The second base 270 has a pair of depressions 272,274 therein at about the right side thereof (with respect to FIG. 14). At about the left side of the base 270 are a second pair of elongated members 276,278 for interconnection with the base 258 of the first baffle 250. The extensions 268 of the elongated members 264,266,276,278 are inserted into the respective depressions 272,274,260,262 and interlock with the bases 258,270 in order to support the first base 258 substantially parallel to the second base 270. In this manner, the array (e.g., 4×10=40) of the first elongated members 254,264,266 is interleaved with a similar array (e.g., 9+3×10=39) of the second elongated members 256,276,278 to form a labyrinth of elongated members in a suitable array (e.g., 19+3×20=79). When the bases 258,270 are so assembled, the ends of the elongated members 254,256 are about adjacent the substantially parallel bases 270,258, respectively, although the invention is applicable to elongated members which engage or which do not engage the other base.

Figure 15:
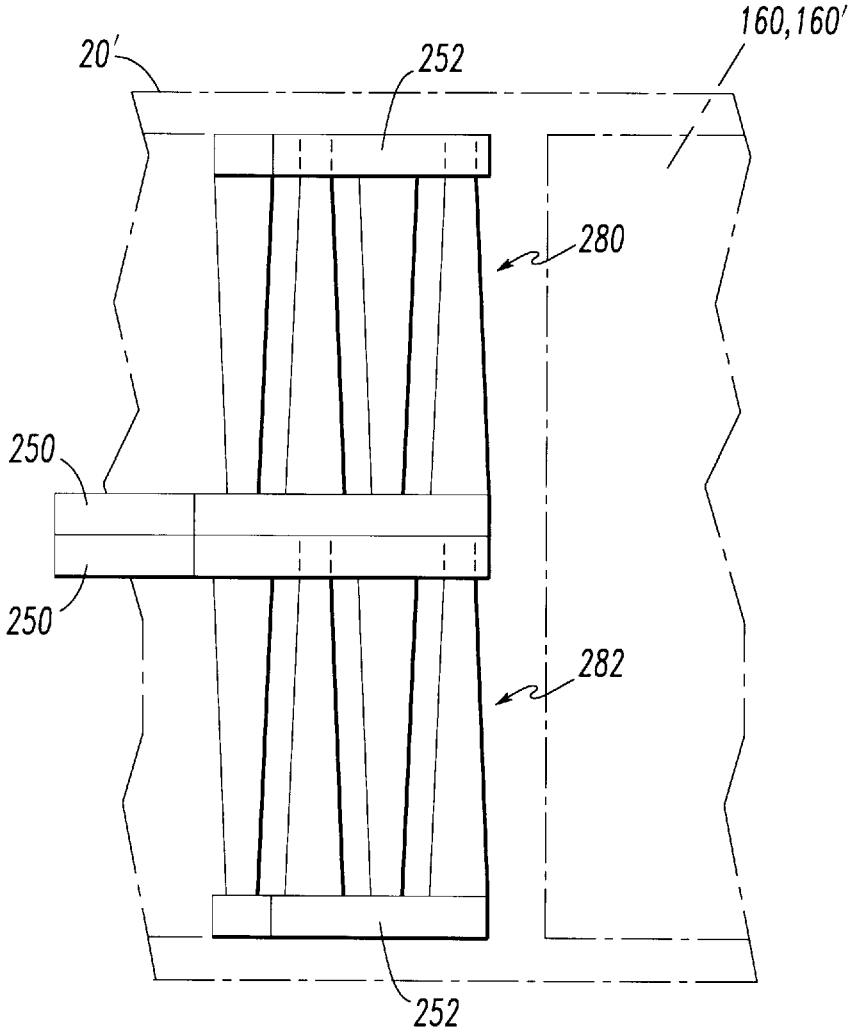
FIG. 15 is a plan view, with respect to a circuit breaker, of two pair of baffles in accordance with another embodiment of the invention.

Referring to FIG. 15, two pair of the baffles 250,252 are illustrated. These may be employed about adjacent an arc chute (shown in phantom line drawing), such as arc chute 160 (FIG. 1) or 160' (FIG. 16), within a circuit breaker 20' (as partially shown in phantom line drawing). Although, two pair of baffles are illustrated, it will be appreciated that any suitable modularity of baffles may be employed (e.g., 2N baffles, such as 2, 4, 6, 8). The upper pair of cooperating baffles 250,252 form a first labyrinth 280 and the lower pair of cooperating baffles 250,252 form a second labyrinth 282, although any suitable count of labyrinths may be employed (e.g., N labyrinths, such as 1, 2, 3, 4).

Figure 16:
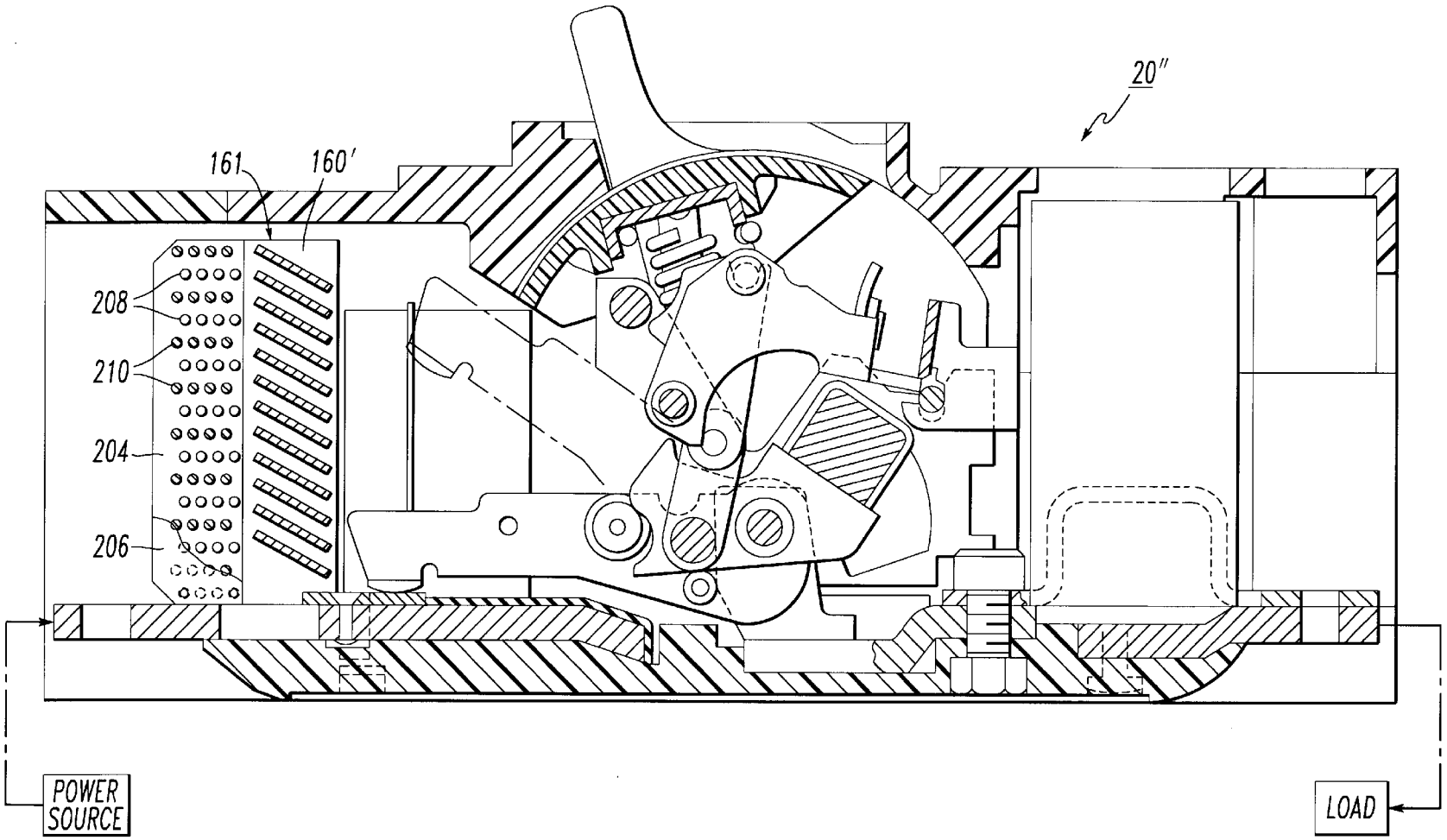
FIG. 16 is a vertical sectional view of a circuit breaker employing a pair of baffles in accordance with the invention.

Referring to FIG. 16, a vertical sectional view of a circuit breaker 20" employing at least one pair of the baffles 204,206 is illustrated. The first baffle 204 is positioned in the arc chamber 161 about adjacent the arc chute 160'. The second baffle 206 is also positioned in the arc chamber 161 about adjacent the arc chute 160' and cooperates with the first baffle 204 as discussed above in connection with FIG. 2. The exemplary baffles 204,206 provide obstacle pathways for arc gas products. The baffles 204,206 force the gases through paths which preferably provide a large surface area for cooling.

The exemplary baffles 204,206,250,252 disclosed herein may be formed using any suitable material such as, for example, nylon, ULTEM™, or a high temperature thermoplastic. As discussed above in connection with FIGS. 2–14, a wide range of cross sections of the elongated members may be employed, although any longitudinally tapered or non-tapered cross section which may easily be formed by a suitable molding process such as injection molding is preferred. It will be appreciated that suitable variations in cross sections may be employed in such process for improved baffle strength and/or improved turbulence of arc gas products.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A baffle apparatus for use in an electrical switching device including separable contact means, and arc chute means for dividing an arc between said separable contact means and releasing arc gas, said baffle apparatus for affecting flow of said arc gas, said baffle apparatus comprising:

first unitary baffle means; and second unitary baffle means, with each of said first and second unitary baffle means comprising:

a base, a plurality of elongated members supported by the base, and means for supporting the base of one of said first and second unitary baffle means substantially parallel to the base of the other of said first and second unitary baffle means, with the elongated members of said one of said first and second unitary baffle means being adjacent to, without interlocking with, said base of the other of said first and second unitary baffle means, and with the elongated members of said first and second unitary baffle means being interleaved to form a labyrinth.

2. The baffle apparatus as recited in claim 1 wherein at least some of the elongated members have a first diameter about adjacent a corresponding one of the bases and a second diameter, smaller than the first diameter, about adjacent the substantially parallel base.

3. The baffle apparatus as recited in claim 1 wherein at least some of the elongated members have a first cross section about adjacent a corresponding one of the bases and a second cross section, which is substantially the same as the first cross section, about adjacent the substantially parallel base.

4. The baffle apparatus as recited in claim 3 wherein at least some of the cross sections are a polygon.

5. The baffle apparatus as recited in claim 3 wherein at least some of the cross sections have an S-shape.

6. The baffle apparatus as recited in claim 3 wherein at least some of the cross sections have an L-shape.

7. The baffle apparatus as recited in claim 3 wherein at least some of the cross sections have a Z-shape.

8. The baffle apparatus as recited in claim 3 wherein at least some of the cross sections have an X-shape.

9. The baffle apparatus as recited in claim 3 wherein at least some of the cross sections have a plus-shape.

10. The baffle apparatus as recited in claim 3 wherein at least some of the cross sections have a shape in the form of a planar curve.

11. The baffle apparatus as recited in claim 10 wherein the planar curve is generally circular.

12. The unitary baffle apparatus as recited in claim 1 wherein at least some of the elongated members of said first unitary baffle means have a first cross section; and wherein at least some of the elongated members of said second unitary baffle means have a second cross section which is substantially a mirror image of the first cross section.

13. The baffle apparatus as recited in claim 12 wherein the first cross section is generally normal with respect to the second cross section.

14. The baffle apparatus as recited in claim 1 wherein said means for supporting the base includes:

a plurality of recesses in the base of one of said first and second baffle means; and a plurality of elongated members having a first end supported by said base of one of said first and second unitary baffle means and having a second end inserted in the recesses of the base of the other of said first and second unitary baffle means.

15. An electrical switching apparatus comprising:

a housing;

separable contacts within said housing having a closed position and an open position;

operating means for operating said separable contacts between the closed position and the open position thereof;

arc chute means for dividing an arc between said separable contacts;

at least one first unitary baffle means about adjacent said arc chute means; and at least one second unitary baffle means cooperating with said at least one first unitary baffle means, with each of said first and second unitary baffle means comprising:

a base, a plurality of elongated members supported by the base, and means for supporting the base of one of said first and second unitary baffle means substantially parallel to the base of the other of said first and second unitary baffle means, with the elongated members of said one of said first and second unitary baffle means being adjacent to, without interlocking with, said base of the other of said first and second unitary baffle means, and with the elongated members of said first and second unitary baffle means being interleaved to form at least one labyrinth.

16. The electrical switching apparatus as recited in claim 15 wherein at least some of the elongated members have a first diameter about adjacent a corresponding one of the bases and a second diameter, smaller than the first diameter, about adjacent the substantially parallel base.

17. The electrical switching apparatus as recited in claim 15 wherein at least some of the elongated members have a first cross section about adjacent a corresponding one of the bases and a second cross section, which is substantially the same as the first cross section, about adjacent the substantially parallel base.

18. An electrical switching apparatus comprising:

a housing having an arc chamber therein;

separable contacts in said arc chamber having a closed position and an open position;

operating means for operating said separable contacts between the closed position and the open position thereof;

arc chute means in said arc chamber for dividing an arc between said separable contacts;

at least one first unitary baffle in said arc chamber about adjacent said arc chute means; and at least one second unitary baffle in said arc chamber cooperating with said at least one first unitary baffle, with each of said first and second unitary baffles comprising:

a base, a plurality of elongated members supported by the base, and means for supporting the base of one of said first and second unitary baffles substantially parallel to the base of the other of said first and second unitary baffles, with the elongated members of said one of said first and second unitary baffles being adjacent to, without interlocking with, said base of the other of said first and second unitary baffles, and with the elongated members of said first and second unitary baffles being interleaved to form at least one labyrinth.

19. The electrical switching apparatus as recited in claim 18 wherein at least some of the elongated members of said first unitary baffle have a first cross section; and wherein at least some of the elongated members of said second unitary baffle have a second cross section which is substantially a mirror image of the first cross section.

20. The electrical switching apparatus as recited in claim 18 wherein said at least one first unitary baffle is a plurality of first unitary baffles; wherein said at least one second unitary baffle is a plurality of second unitary baffles; and wherein said at least one labyrinth is a plurality of labyrinths, with each one of said second unitary baffles cooperating with a corresponding one of said first unitary baffles, and with each pair of the first and second unitary baffles forming one of said labyrinths.

21. The electrical switching apparatus as recited in claim 15 wherein said first and second unitary baffle means are formed by a molding process.

22. The electrical switching apparatus as recited in claim 21 wherein said molding process is injection molding.

* * * * *